US005103261A

United States Patent [19]

Matsuo et al.

[11] Patent Number: 5,103,261

[45] Date of Patent: Apr. 7, 1992

[54] CLAMSHELL TYPE COLOR IMAGE FORMING APPARATUS

[75] Inventors: Shunji Matsuo; Shizuo Morita; Satoshi Heneda; Masakazu Fukuchi; Seiko Nagamuma; Masahiko Itaya, all of Hachioji, Japan

[73] Assignee: Konica Corporation, Tokyo, Japan

[21] Appl. No.: 553,966

[22] Filed: Jul. 17, 1990

[30] Foreign Application Priority Data

Jul. 19, 1989 [JP] Japan ..... 1-187708
Aug. 25, 1989 [JP] Japan ..... 1-220020

[51] Int. Cl.[5] ..... G03G 15/00; G03G 15/01

[52] U.S. Cl. ..... 355/210; 346/160.1; 355/200; 355/327

[58] Field of Search ..... 355/200, 326, 327, 210, 355/271, 272; 346/160.1

[56] References Cited

U.S. PATENT DOCUMENTS

| | | | |
|---|---|---|---|
| 4,642,661 | 2/1987 | Dean, II | 346/153.1 |
| 4,814,817 | 3/1989 | Nishijima et al. | 355/200 |
| 4,875,069 | 10/1989 | Takada et al. | 355/326 X |
| 4,924,267 | 5/1990 | Yoshikawa et al. | 355/210 |
| 4,935,788 | 6/1990 | Fantuzzo et al. | 355/326 |
| 4,947,215 | 8/1990 | Chuang | 355/326 X |
| 4,952,974 | 8/1990 | Mori | 355/200 |
| 4,994,853 | 2/1991 | Fukuchi et al. | 355/327 X |

FOREIGN PATENT DOCUMENTS

| | | | |
|---|---|---|---|
| 58-72159 | 4/1983 | Japan . | |
| 61-123257 | 6/1986 | Japan . | |
| 0083781 | 4/1988 | Japan | 355/290 |

*Primary Examiner*—A. T. Grimley
*Assistant Examiner*—Nestor R. Ramirez
*Attorney, Agent, or Firm*—Frishauf, Holtz, Goodman & Woodward

[57] ABSTRACT

A camshell type photoelectric color image printer includes a photoreceptor for holding a latent image on its surface, a charger for charging the surface of the photoreceptor, a laser writer for forming a latent image on the charged surface of the photoreceptor, plural developers for developing the latent image with color toners, a transfer drum for holding a recording sheet on which the developed latent image is transferred, a cleaner for cleaning residual toner on the photoreceptor, and a cartridge which holds the photoreceptor, the developers, the cleaner and the transfer unit. The developers are located under the photoreceptor, and the cartridge is removable from the color image printer. An upper part of the color image printer is movable relative to the main body of the printer. The transfer drum is located at an upper position of the photoreceptor in the printer, so that a recording sheet can be easily removed from the printer when the recording sheet is jammed in a circumferential portion of the transfer drum.

2 Claims, 11 Drawing Sheets

CLAMSHELL TYPE COLOR IMAGE FORMING APPARATUS

BACKGROUND OF THE INVENTION

This invention relates to a color image clamshell type forming apparatus such as a color printer, a color copier and the like. More particularly it relates to a color image forming apparatus which can be easily maintained and which can stably form color images by adopting a process cartridge including image forming units.

A conventional color image forming apparatus in which a transfer drum is used, is disclosed in Japanese Patent Publication Open to Public Inspection No. 123257/1986. In the color image forming apparatus described therein, a color image is formed as follows: a document image is read out; a latent image is formed on a photoreceptor by laser beams which were modulated by obtained from said document image digital signal; the latent image is developed by a rotary type of color developing unit; and the thus obtained toner images are superimposed on each other on a transfer paper which is wound around a transfer drum so that a color image can be formed on the paper. Since the photoreceptor drum, the rotary type of developing unit, the transfer drum, and the like are individually provided to the apparatus in this case, the size of the apparatus becomes large as a whole and furthermore it is difficult to replace parts for maintenance work and to remove jammed paper when jamming has occurred in the apparatus.

In order to solve the problem explained above, a transfer drum type of color image forming apparatus has been proposed in Japanese Patent Publication Open to Public Inspection No. 72159/1983, which has a process cartridge to which a photoreceptor drum, a charger, a plurality of developing units, a cleaning unit, and the like are integrally provided.

In this prior art, the image forming units are provided in the process cartridge which can be easily attached to and removed from the apparatus, so that the image forming units can be replaced as required. Accordingly, the quality of the color images formed by this prior art apparatus was stabilized. The apparatus was compact, and the weight of the apparatus was decreased.

However, the color image forming apparatus disclosed in the above-described Japanese Patent Publication Open to Public Inspection No. 72159/1983, is provided with a plurality of thin developing units which are stacked horizontally. Consequently, the apparatus has the following disadvantages: the developer can not be sufficiently stirred in the developing unit and accordingly triboelectric charging is not fully sufficient; mixing of color toner tends to occur between adjacent developing units; and the quality and resolving power of a color image are deteriorated. As the image transfer means including the transfer drum is located under the photoreceptor drum, the cleaning unit and a plurality of developing units, the image tends to be contaminated by toner leaked from the cleaning unit and the developing units so that the image quality is further deteriorated.

In the color image forming apparatus described above, the image forming units and the transfer drum are separately removed when jamming occurs. Therefore, a large space is needed to remove the image forming units and the transfer drum, and furthermore repositioning is troublesome when this removed apparatus is re-attached to the apparatus.

A first object of the present invention is to provide a color image forming apparatus which can stably form a color image of high quality and which can be made compact.

A second object of the present invention is to provide a color image forming apparatus which can stably form a color image of high quality, and which can be made compact and can be easily maintained as the image forming units, the transfer drum and the like are integrally assembled into a compact cartridge.

SUMMARY OF THE INVENTION

The first object of the present invention described above can be accomplished by a color image forming apparatus which is provided with a clamshell type photoreceptor drum, a charger, a writing means to write color data on the above-described drum, a plurality of developing units, and a cleaning unit and a transfer drum; and which is characterized in that a process cartridge, in which at least the photoreceptor drum, the charger, a plurality of developing units located under the photoreceptor drum and the cleaning units are installed, is is removable from the apparatus; the transfer drum said cartridge located above the photoreceptor drum in the apparatus; and a lid is provided to the upper portion of the apparatus which can be opened for jam-clearing so that the transfer drum can be exposed in order to remove jammed papers.

Furthermore, the second object of the present invention can be accomplished by a clamshell type color image forming apparatus which has a photoreceptor drum, a charger, a writing means to write color data on the photoreceptor drum, a plurality of developing units, a waste toner collecting unit and a transfer drum, and which is characterized in that an upper box unit, which can be opened and closed, is provided in the apparatus; a process cartridge is also provided and includes at least the photoreceptor drum, a plurality of developing units located under the photoreceptor drum, the charger, the waste toner collecting unit and the transfer drum located above the photoreceptor drum; and the process cartridge can be removed upward when the upper box unit is opened.

BRIEF DESCRIPTION OF THE DRAWINGS

FIG. 11(*b*) is a partial sectional view of the process cartridge.

DETAILED DESCRIPTION OF THE INVENTION

Figure 1:
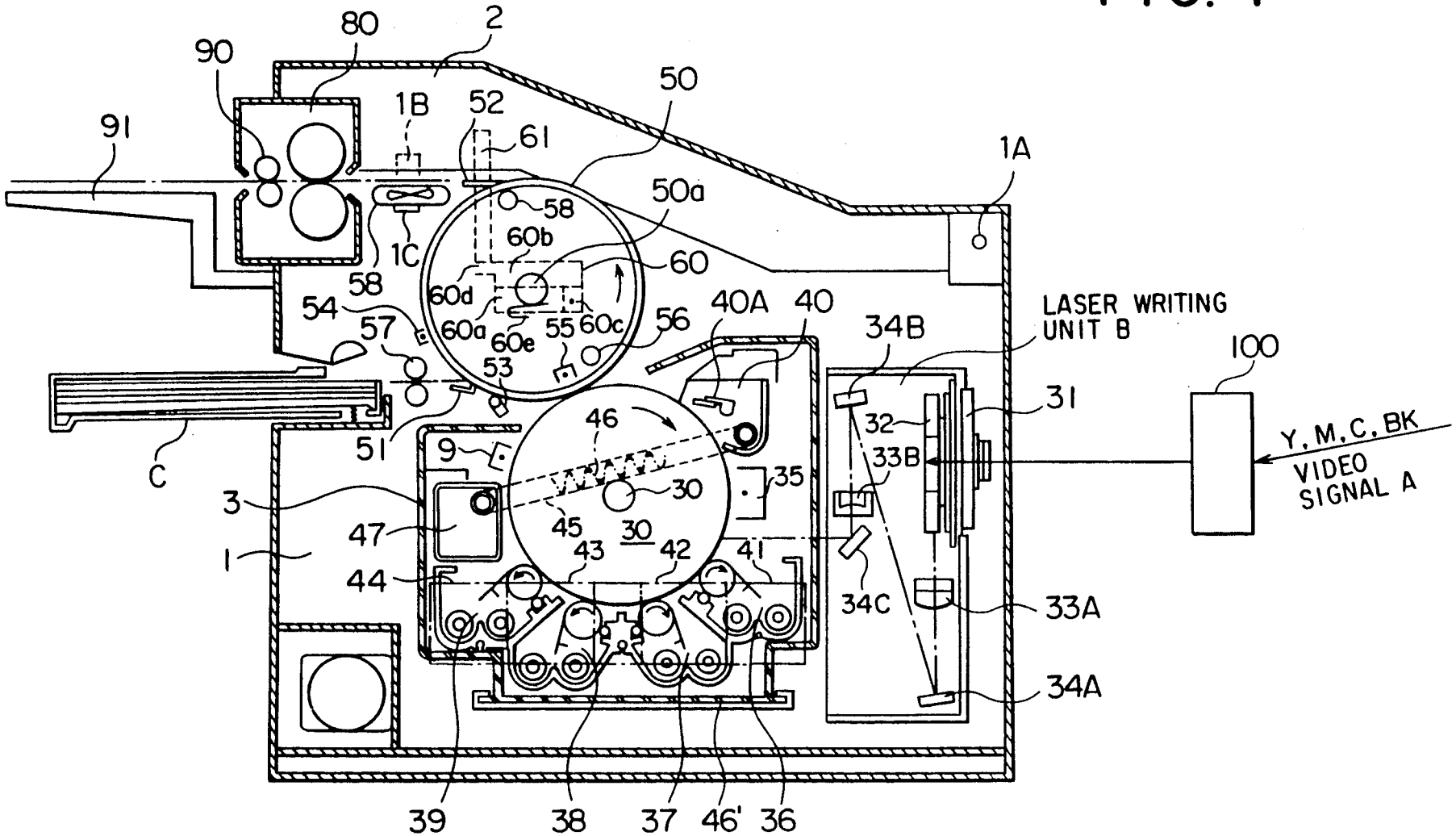
FIG. 1, FIG. 2, FIG. 5, and FIG. 6 are sectional views of examples of the color printer of the present invention.

In the color image forming apparatus to accomplish the first objects of the present invention, the process cartridge which can be easily attached to and removed from the apparatus, is provided wherein the cartridge comprises the photoreceptor drum and the following units which are provided around the photoreceptor drum: the charger which impresses uniform potential on the photoreceptor drum; a plurality of developing units of yellow (Y), magenta (M), cyan (C) and black (BK); the cleaning unit; the waste toner collecting unit to collect the toner scraped off from the photoreceptor drum by the cleaning unit; and a pre-transfer charger. A plurality of developing units which are built in the cartridge, are vertically arranged surrounding the lower circumferential surface of the photoreceptor drum. The one-component-developer, which is mainly composed of magnetic toner, and the two-component-developer, which is composed of nonmagnetic toner and a magnetic carrier, are used in the apparatus described above. However, the two-component-developer is preferably used which is excellent for reproducing the tone of color images.

In the color image forming apparatus of the present invention, a transfer drum is used as the transfer means, wherein the transfer drum is located above the photoreceptor drum. Because the image forming process is following the sequence of cleaning—charging—exposure—developing—transfer, the cleaning unit, the charger and the like are located along the right side of the circumferential surface of the photoreceptor drum. For that reason, the transfer drum is located on the left side of the photoreceptor drum so that the apparatus can be balanced. When the horizontal plane on which the shaft center of the photoreceptor drum lies, makes an angle of $\theta$ with the inclined plane on which both the shaft center of the photoreceptor drum and the shaft center of the transfer drum lie, it is common that the value of $\theta$ is represented by the inequality of $10° \leqq \theta \leqq 80°$, and it is preferable that the value of $\theta$ is represented by the inequality of $20° \leqq \theta \leqq 70°$.

The transfer paper cassette of this color image forming apparatus is provided on the left side of the apparatus or to the upper portion of the lid and the transfer paper is conveyed to the transfer drum in the transfer unit located in the upper portion of the photoreceptor drum.

One of the methods to transfer toner images onto a transfer paper in the above-described transfer unit is as follows: the conveyed transfer paper is wound around the transfer drum and fixed by a clamper; and the toner image of each color which is formed on the circumferential surface of the photoreceptor drum, is transferred onto the transfer paper so that the toner images can be superimposed. The other method to transfer toner images is as follows: the toner image of each color which was formed on the circumferential surface of the photoreceptor drum, is directly transferred onto the surface of the transfer drum so that a color toner image can be formed on the transfer drum; and the color toner image is transferred at once onto the transfer paper conveyed from the transfer paper cassette. Either method may be adopted.

A lid is provided to the upper portion of the apparatus. When the lid is opened, the upper portion of the transfer drum and the transfer paper delivery unit are exposed so that jamclearing can be performed when necessary.

When the above-described lid is opened, the engagement means to position the transfer drum and the photoreceptor drum is released so that the process cartridge can be pulled out of the apparatus. When the lid is closed, the above-described engagement means is locked so that image forming can again be performed in the apparatus. The transfer drum may be interlocked with the lid so that the transfer drum can be integrally moved together with the lid when it is opened. In the case of a color copier, a color scanner is provided to the above-described lid.

As the color image forming apparatus of the present invention has the structure described above, it has the following advantages: the quality of color images can be improved and a color image of high quality can be stably formed; although a transfer drum is used in the apparatus, the apparatus can be made compact and well-balanced; and although the transfer drum is located off to the upper right or left of the photoreceptor drum, the center of gravity of the apparatus is placed at the lower center so that the apparatus is well-balanced and shockproof.

In order to increase the life of the process cartridge, it is preferable that a toner supply unit is provided to the front or the back of the apparatus. Furthermore, it is preferable that a waste toner collecting unit, which collects the waste toner scraped off from the photoreceptor drum by the cleaning unit, is provided to the process cartridge.

In the following examples are described several preferred embodiments to illustrate the present invention. However, it is to be understood that the invention is not intended to be limited to the specific embodiments.

EXAMPLE 1

Figure 2:
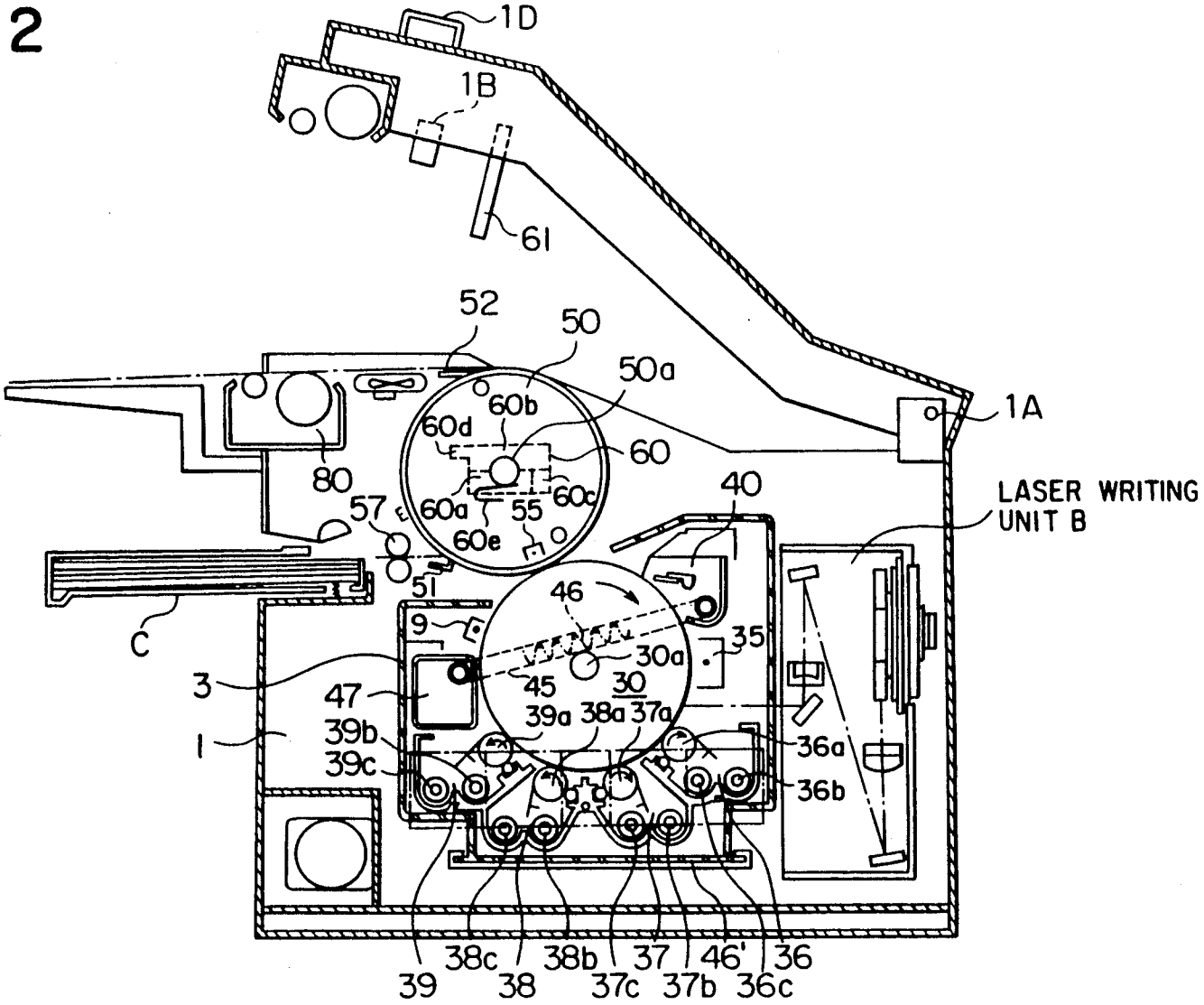
Figure 3:
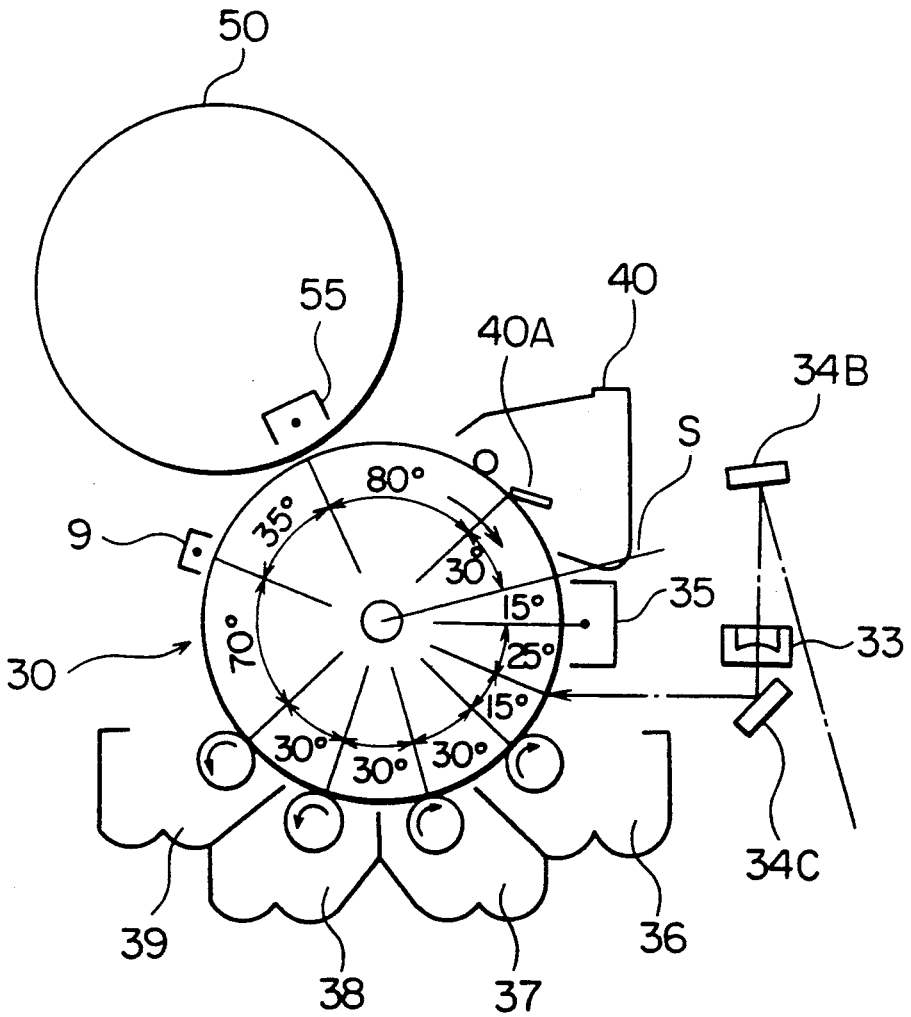
FIG. 3 is a schematic illustration which explains the arrangement of each image forming unit in the process cartridge.
Figure 4:
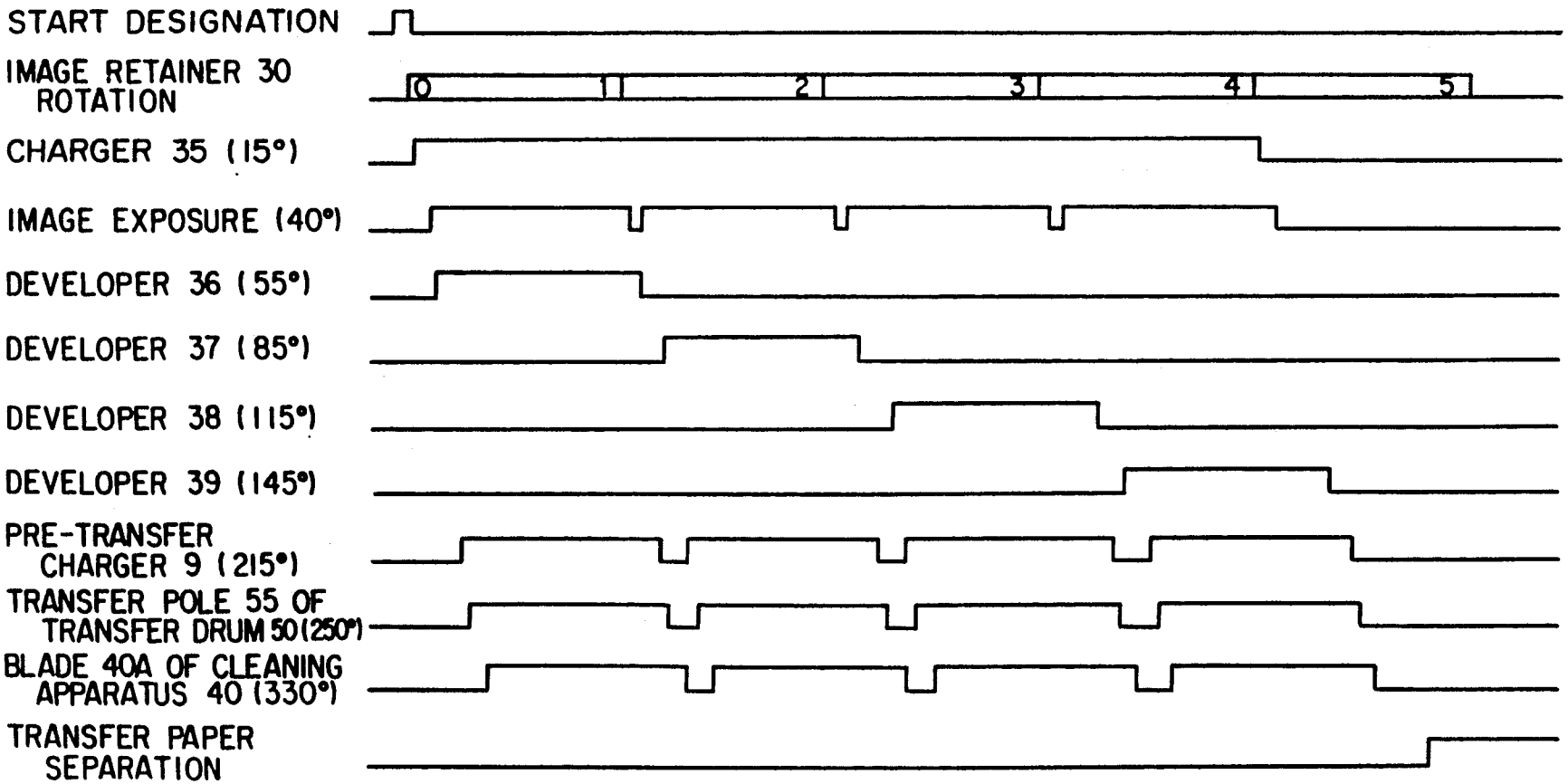
FIG. 4 is a time chart which illustrates image forming in Example 1 of the present invention.

FIGS. 1, 2, 3 and 4 are drawings which explain an example of the apparatus of the present invention. FIG. 1 and FIG. 2 are sectional views of the printer of the present example. FIG. 3 is a schematic illustration which shows the arrangement of image forming units in the process cartridge. FIG. 4 is a time chart of image forming.

The printer of this example has the following structure: the lid 2 which includes the upper half of the fixing unit is provided to the apparatus 1, wherein the lid 2 and the apparatus 1 are connected by the hinge 1A as illustrated in FIG. 2 and the lid can be opened by an angle of 30° to 60°; and when the lid 2 is closed, it is fixed to the apparatus 1 by the latch 1B.

The photoreceptor drum 30, the charger 35, the developing units 36, 37, 38 and 39 of Y(yellow), M(Magenta), C(Cyan) and BK(Black), the pre-transfer charger 9, the cleaning unit 40, and the toner collecting unit 47 are integrally provided to the process cartridge 3. The process cartridge 3 is installed inside the apparatus 1, wherein the process cartridge 3 can be easily attached to and removed from the apparatus 1. As illustrated in FIG. 1 and FIG. 2, the transfer drum 50 is placed off to the upper left of the photoreceptor drum 30 provided to the process cartridge 3, wherein its shaft 50*a* is rotatably supported by the bearing 60 which is provided to the apparatus 1. The above-described bearing 60 is composed of the stationary unit 60*a* and the movable unit 60*b* which can be rotated around the shaft 60*c*. When the lid 2 is closed in the apparatus 1 as illustrated in FIG. 1, the push rod 61 which is fixed to the lid 2 pushes the tip 60*d* of the movable unit 60*b* of the bearing 60 resisting the force of the spring 60*e*. Accordingly, the movable unit 60*b* is pressed against the stationary unit 60*a* and fixed to it and at the same moment, the transfer drum 50 is positioned with regard to the photoreceptor drum 30. As explained before, when the lid is closed, the latch 1B engages with the engagement member 1C provided to the apparatus so that the lid is locked to the apparatus.

In order to take out the process cartridge 3 from the apparatus 2, the following operation is conducted: the latch 1B is released and the lid 2 is opened so that the force given to the movable unit 60*b* of the bearing 60 by the push rod 61 can be removed; the transfer drum 50 is separated from the photoreceptor drum 30 by the action of the spring 60*e* which is provided to the stationary unit 60*a* of the bearing 60.; and the cartridge 3 can be pulled out to the operator's side with a handle (not illustrated in the drawing) provided on the front of the apparatus.

The developing units 36, 37, 38 and 39 which are installed in the cartridge 3, share the walls of the housing so that the developing units can be integrally composed. To be more concrete, the developing unit 36 is adjacent to the developing unit 37 and the wall between the developing unit 36 and the developing unit 37 is shared by them. The situation is the same in the case of developing unit 38 and the developing unit 39. The four developing units are arranged around the lower circumferential surface of the photoreceptor drum 30. The developing units 36, 37, 38 and 39 are vertically arranged, wherein the openings at the side of the developing rollers 36*a*, 37*a*, 38*a* and 39*a* are placed upward. For that reason described above, the efficiency of stirring and mixing the developer by the stire rollers 36*b*, 36*c*, 37*b*, 37*c*, 38*b*, 38*c*, 39*b*, and 39*c* in the developing units, and of triboelectric charging can be improved. As a result, high developing performance can be attained. Furthermore, harmful effects such as leak of developer, environmental pollution caused by developer and mixing of color, can be prevented.

Referring to the printer of the present invention, the laser writing unit B is located on the right side of the process cartridge 3. Transfer papers are supplied to the transfer drum 50 from the transfer paper cassette C which is located on the left side of the transfer drum 50. A transfer paper is wound around the transfer drum 50 and fixed by the clamper 51. After a color toner image is transferred onto the transfer paper, it is fixed by the fixing unit 80. Then, the transfer paper is delivered to the left side of the transfer drum 50.

The toner supply units 41, 42, 43 and 44 are provided to the back of the apparatus 1 and supply their toner when the toner in each developing unit is consumed. The waste toner scraped off by the cleaning unit 40 is collected through the waste toner conveying tube 45 by the waste toner collecting unit 47 which is provided in the process cartridge 3.

As the printer of this example has the structure explained above, the apparatus has the following advantages: the apparatus can be made compact; as the center of gravity is located lower, the structure is well-balanced and can resist shock; when a paper-jam has occurred around the transfer drum, jam-clearing can be easily conducted; and the process cartridge can be easily attached to and removed from the apparatus. The apparatus having the structure described-above, further has the following advantage: when the lid is opened, the circumferential surface of the photoreceptor drum is shaded by the transfer drum and the fatigue of the photoreceptor drum can be prevented, wherein the fatigue is caused by exposure of the drum during jam-clearing.

In this example, image forming was conducted with the color printer illustrated in FIG. 1 and FIG. 2 as follows.

The laser beam emitted by the semiconductor laser unit 100 was modulated by the video signal A and the modulated laser beam was projected into the laser writing unit B.

At the first revolution of the photoreceptor drum 30, the uniform charge of −700 V was impressed on the drum by the charger 35. Then, the laser beam sent from the semiconductor laser unit 100 was modified by Y signal which was the first video signal and the obtained laser beam was projected into the laser writing unit B. In the laser writing unit B, scanning was performed by the polygon mirror 32 which was driven by the high-speed-motor 31 and the laser beam was irradiated on the surface of the photoreceptor drum 30 of 120 mm$\phi$ diameter through the collimator lens 33A, the reflecting mirrors 34A, 34B and 34C, and the f-$\theta$ lens 33B so that the electrostatic latent image of Y was formed. This electrostatic latent image was developed by the method of noncontact-reversal-development in the Y-developing unit 36 in which a two-component developer was contained and on which the developing bias was impressed, wherein the D.C. component of the developing bias was −600 V and the A.C. component was 3 KHz, 500 V. In this way, the Y-toner image was formed on the photoreceptor drum 30. This Y-toner image was transferred onto a transfer paper wound around the transfer drum 50 which was rotated synchronously with the photoreceptor drum 30 and which has the same diameter as the photoreceptor drum 30.

The transfer paper was conveyed from the transfer paper supply cassette C to the transfer drum 50 through the timing roller 57 synchronously with image forming of the photoreceptor drum 30, and the transfer paper was mechanically and electrostatically wound around the transfer drum 50 by the clamper 51 and the solenoid pressing member 53, wherein the surface of the transfer drum 50 was charged by the charger 54 in advance. The above-described Y-toner image on the photoreceptor drum 30 was transferred by the action of the transfer pole 55 which was driven by the pole drive unit 56 synchronously with the transfer drum 50, onto the transfer paper wound around the transfer drum 50. The residual toner which remained on the photoreceptor drum after transferring, was cleaned by the cleaning unit 40.

After the photoreceptor drum 30 was charged by the charger 35 at the second revolution of the photoreceptor drum 30 and the transfer drum 50, the laser beam which was modified by the M-video signal was written on the photoreceptor drum 30. Then, the M-toner image was developed by the M-developing unit in the same way as described before. This M-toner image was superimposed on the Y-toner image on the transfer paper which was wound around and fixed on the transfer drum 50, wherein, the transfer drum 50 was rotated synchronously with the photoreceptor drum 30 under the condition the separating claw 52 was released. The residual toner which remained on the photoreceptor drum 30 after transferring, was cleaned by the cleaning unit 40 and the photoreceptor drum 30 was charged by the charger 35 again. Then, at the third and fourth revolution of the photoreceptor drum 30 and the transfer drum 50, the C-toner image and the BK-toner image which were formed on the photoreceptor drum 30 according to the C-video signal and the BK-video signal, were superimposed on the Y-toner image and the M-toner image on the transfer paper which was wound around the transfer drum 50 so that a color toner image could be formed. The transfer paper onto which the color toner image was transferred, was separated from the transfer drum by the separating claw 52 and conveyed by the suction conveyance belt 58 to the fixing unit 80 so that the color toner image could be fixed. After fixing, the transfer paper was delivered onto the delivery tray 91 so that the color image was obtained. The blade 40A of the cleaning unit 40 is continuously activated from the start to the end of image forming.

FIG. 3 is a schematic illustration which shows the positional relationships between the photoreceptor drum 30 and the image forming units provided to the process cartridge 3 comprising the charger 35, the developing units 36, 37, 38 and 39, and the cleaning blade 40A of the cleaning unit, wherein the image forming units are illustrated in FIG. 1 and FIG. 2.

Assume that the photoreceptor drum 30 is rotated clockwise in FIG. 3 and the mark S shows the standard position. In the drawing, the phase of revolution of the photoreceptor drum at the end of cleaning and the positions of image forming units are shown by the angle.

In this case, the processes such as charging, latent image forming, toner image forming, transferring and cleaning of the residual toner are performed according to the time chart shown in FIG. 4. While the photoreceptor drum was rotated by 5 revolutions, the transfer of an image of each color onto the paper on the transfer drum, the separation of transfer paper from the transfer drum, the cleaning of the photoreceptor drum and the like, were completed, which was defined as one cycle.

The waste toner which was removed from the photoreceptor drum 30 by the cleaning unit 40 and collected by the collecting unit, was collected to the waste toner collecting unit 47 installed in the process cartridge 3 through the waste toner conveyance tube 45 which was provided to the front of the process cartridge 3.

The waste toner conveyance screw 46 which was a flexible structure, was built in the above-mentioned waste toner conveyance tube 45, wherein the waste toner conveyance screw 45 was driven by the drive system of the apparatus 2 or the upper box unit 1, and the waste toner was conveyed by the conveyance force generated by the rotation of the conveyance screw 46. A tube made from synthetic resin which was excellent in mold releasing performance, was used for the material of the waste toner conveyance tube 45 so that the waste toner conveyance screw 46 could be operated smoothly.

Furthermore, the arrangement of the developing units will be explained as follows. In the process cartridge 3, the developing units 36, 37, 38 and 39 are provided to both the right side and the left side with regard to the center line of the photoreceptor drum 30. To be more concrete, the developing units 36 and 37 are located at the position on the right side of the shaft center of the photoreceptor drum 30 and the developing units 38 and 39 are symmetrically located at the position on the left side of the shaft center of the photoreceptor drum 30. Furthermore, the developing sleeves of the developing units 36 and 37 which are located on the right side are rotated clockwise, and the developing sleeves of the developing units 38 and 39 which are located on the left side are rotated counterclockwise so that the development of image can be conducted.

As the developing units are arranged symmetrically as described above and two of the developing sleeves are rotated in the opposite direction of the other two, the process cartridge 3 is well-balanced in terms of weight and motive power transmission. Accordingly, its maneuverability is excellent and harmful oscillation can be prevented.

Furthermore, this apparatus has the following advantages: the developing units which are located symmetrically, can have common structure; and the residual toner can be efficiently scraped off from the developing sleeve by the action of gravity after development has been completed, and the adequate amount of fresh toner can be always supplied.

In this example, color images were formed 30,000 times while the following processes were repeated: the toner was supplied from the toner supply units 41, 42, 43 and 44; the residual toner was scraped off by the cleaning unit 40; and the waste toner was collected by the waste toner collecting unit. The result was the color images of high density and high resolution could be always obtained. However, consideration was given to the fatigue of the carrier in the developer, and the process cartridge was replaced to a new one when the 20,000th color image was formed.

EXAMPLE 2

Figure 5:
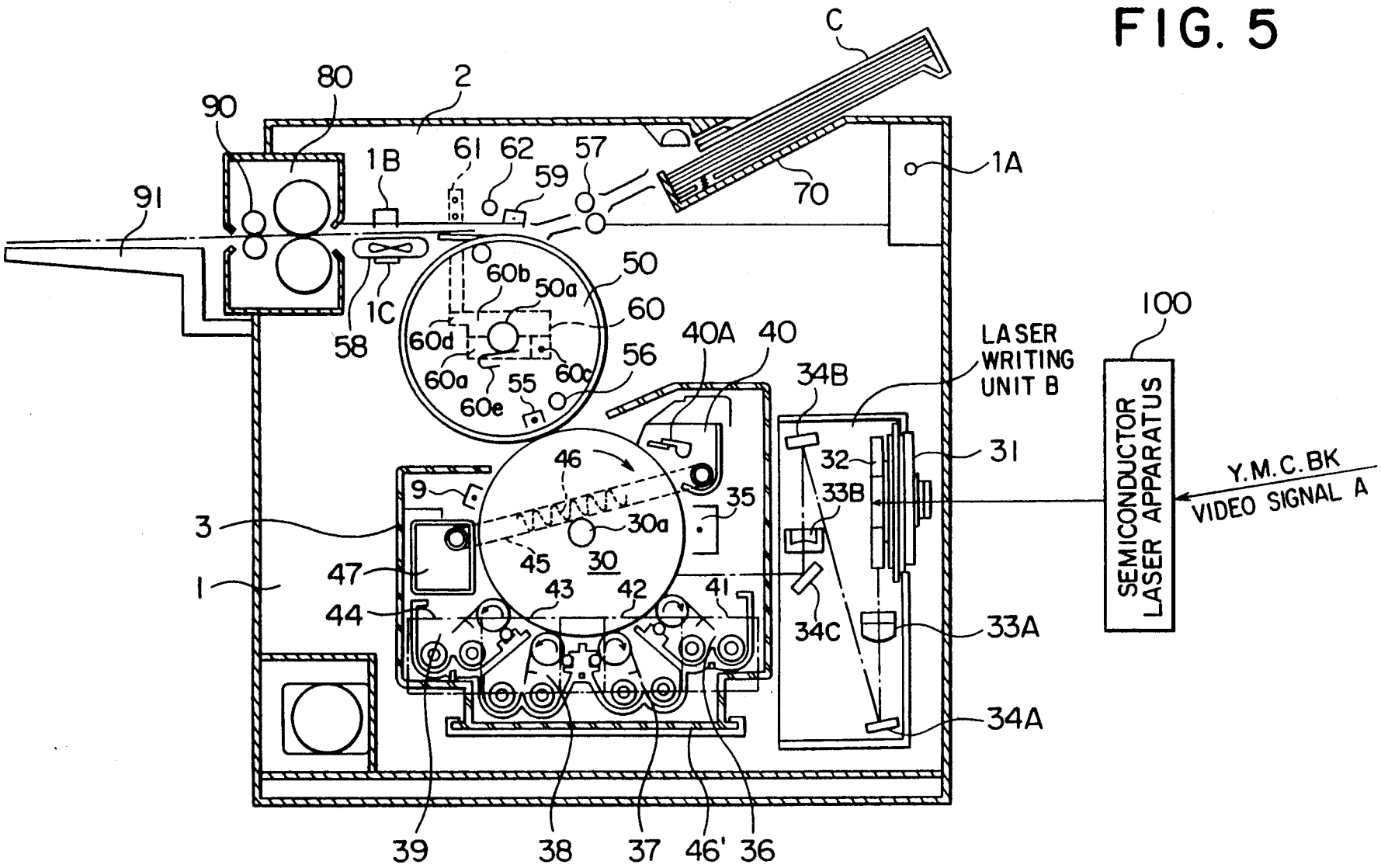

FIG. 5 is a sectional view to explain this example. This example is different from the example illustrated in FIG. 1 in the following points. In the drawing, the same portions have the same numerals.

In this example, the color toner images formed on the surface of the photoreceptor drum 30, were superimposed on the surface of the transfer drum 50 in order so that the images could be transferred onto the transfer drum 50. The color toner images were formed on the transfer drum 50 in the way described above. The color toner image on the transfer drum 50 was transferred in a lump onto the transfer paper by the action of the transfer pole 59, wherein the transfer paper was conveyed through the timing roller 57 from the paper cassette C provided to the cassette attachment portion 70 located on the upper surface of the lid 2. Then, the transfer paper was conveyed by the suction conveyance belt 58 to the fixing unit 80 so that the image could be fixed by heat to form a color image. Accordingly, the clamper to wind and fix the transfer paper on the transfer drum 50, the electrostatic suction unit, and the separating member to separate the transfer paper from the transfer drum 50, were not necessary in this example. The transfer poles 55 and 59 and the drive means 56 and 61 to turn on and off these transfer poles, are provided to the apparatus of this example. The following are provided to the lid 2: the push rod 61; the engaging member 1B; the transfer paper supply cassette C which is located outside the upper box unit of the fixing unit 80; the upper roller of the timing rollers 57; the transfer pole 59; and the drive means 12 to drive the transfer pole 59. The color printer and the other units illustrated in FIG. 5 have the same structure as the apparatus of Example 1 illustrated in FIG. 1. As shown in the time chart in FIG. 4, the process of the separation of the transfer paper from the transfer drum was replaced by the process of the transfer of color toner images formed on the transfer drum onto the transfer paper.

Color images were formed 30,000 times by the apparatus of Example 2 explained above in the same way as the apparatus of Example 1. The result was that color images of high density and high resolution were obtained in the same way as Example 1.

The cases in which the present invention was applied to a color printer, were explained above. However, the present invention can be applied to a color copier to which a color scanner is provided. In the above-described examples, both the diameter of the photoreceptor drum and that of the transfer drum were the same, which was 120 mmϕ. However, the photoreceptor drum can be the demand type, for instance the diameter of the drum can be 60 mmϕ. In this case, the process cartridge 3 can be made more compact and its weight can be made lighter so that the process cartridge 3 can be more easily attached to and removed from the apparatus.

EXAMPLE 3

Figure 6:
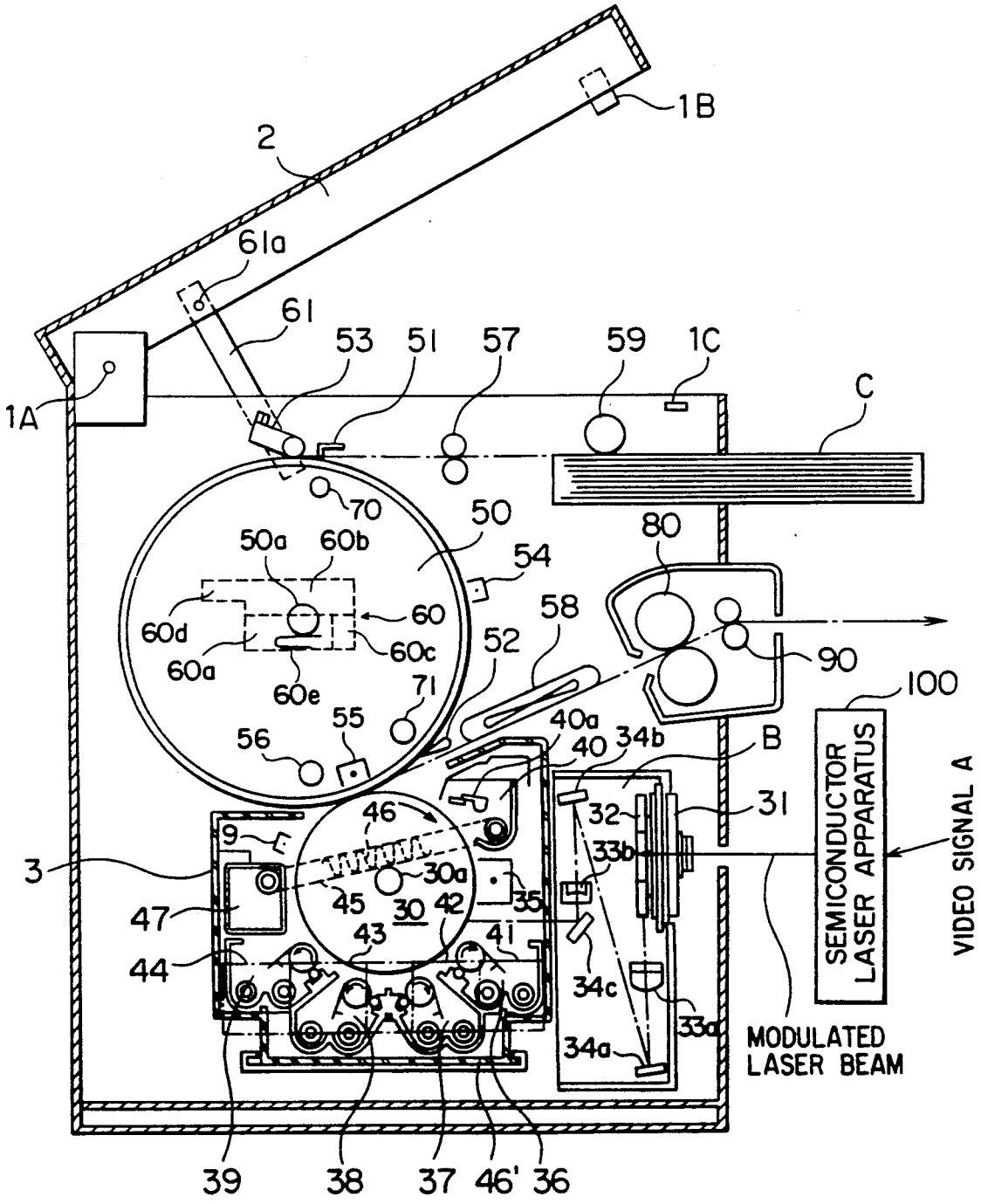

Example 3 is illustrated in FIG. 6. The units of Example 3 which are the same as those of Example 1, are given the same numerals in the drawing.

In this example, the lid 2 which can be opened and closed with regard to the apparatus 1, is provided. When the lid 2 is opened, the upper surface of the transfer drum 50 is exposed so that jam-clearing can be conducted. When the lid 2 is closed, the latch 1B engages with the engagement member 1C, and at the same time the transfer drum 50 is positioned with regard to the photoreceptor drum 30 by the action of the push rod 61 which is fixed to the lid 2 by the bolt 61*a*. When the lid 2 is closed, the push rod 61 which is fixed to the lid 2 is lowered, and the push rod 2 pushes the movable bearing 60*b* of the bearing 60 resisting the force of the spring 60*e*, wherein the bearing 60 is composed of the stationary bearing 60*a* and the movable bearing 60*b*, so that the transfer drum 50 can come into contact with the photoreceptor drum 30 with pressure so as to be positioned with regard to the photoreceptor drum 30.

In this color image forming apparatus, a process cartridge which can be easily attached to and removed from the apparatus being guided by the guide member 46', is provided, wherein the photoreceptor drum 30, the charger 35, the developing units 36, 37, 38 and 39 of Y, M, C and BK, the pre-transfer charger 9, the cleaning unit 40 and the toner collecting unit 47 are integrally installed in the cartridge.

The process cartridge 3 can be removed from the apparatus 1 as follows: the latch 1B is released and the lid 2 is opened; the transfer drum 50 is separated from the photoreceptor drum 30 by the action of the spring 60*e* which is provided to the stationary bearing 60*a* of the bearing 60; and the cartridge is pulled out by a handle (not illustrated in the drawing) to the operator's side.

The developing units 36, 37, 38 and 39 are installed in the above-described process cartridge 3 wherein they adjoin one another, and they share the housing walls so that they can be integrally installed in the cartridge. They are arranged around the lower circumferential surface of the photoreceptor drum. The developing units are vertically arranged, wherein the openings at the sides of the developing rollers 36*a*, 37*a*, 38*a* and 39*a* are located upward.

The developing units 36 and 37 are located on the right side with regard to the center of the drum 30 shaft and the developing units 38 and 39 are located on the left side with regard to the drum 30 shaft, wherein the developing unit 36 and the developing unit 39 are located symmetrically with regard to the drum shaft, and the developing unit 37 and the developing unit 38 are also located symmetrically with regard to the drum shaft. The developing sleeves of the developing units 36 and 37 are rotated clockwise and the developing units 38 and 39 are rotated counterclockwise so that the image developing action can be conducted.

As the developing units are arranged symmetrically as described above and two of the developing sleeves are rotated in the opposite direction of the other two, the process cartridge 3 is well-balanced in terms of weight and motive power transmission. Accordingly, its maneuverability is excellent and harmful oscillation can be prevented.

Furthermore, this apparatus has the following advantages: the developing units which are located symmetrically, can have common structure; and the residual toner can be efficiently scraped off from the developing sleeve with the action of gravity after development has been completed so that the adequate amount of fresh toner can be always supplied.

The toner supply units 41, 42, 43 and 44 are provided to the back of the apparatus and the toner is supplied to the developing units respectively in accordance with the consumption of the toner in each of the units. The waste toner scraped off by the cleaning unit 40, is sent to the waste toner collecting unit 47 built in the process cartridge through the waste toner conveyance tube 45.

This electrostatic latent image which was formed on the photoreceptor drum 30 was developed by the method of noncontact-reversal-development with the Y-developing unit 36 in which a two-component developer was contained and on which the developing bias was impressed, wherein the D.C. component of the developing bias was −500 V and the A.C. component was 3 KHz, 1 KV. In this way, the Y-toner image was formed on the photoreceptor drum 30. This Y-toner image was transferred onto a transfer paper conveyed from the transfer paper cassette C and wound around the transfer drum 50 which was rotated synchronously with the photoreceptor drum 30.

The transfer paper was conveyed from the transfer paper supply cassette C to the transfer drum 50 through the timing roller 57 synchronously with image forming of the photoreceptor drum 30. The clamper 51 of the transfer drum 50 was activated by the operation member 70, and it clamped the tip of the transfer paper. At the same moment, the transfer paper was electrostatically attracted by the transfer drum which was charged by the charger 54 beforehand, so that transfer paper was wound around the transfer drum. The presser 53 is for winding the transfer paper around the transfer drum uniformly. The above-described Y toner image was transferred onto the transfer paper on the transfer drum by the action of the transfer pole 55 which was driven by the pole operation unit 56. The transfer paper onto which the Y toner image was transferred, was rotated so that the next color toner image could be transferred, wherein the separation claw 52, the charger 54 and the presser 53 were kept in the in operative position. While the image was formed on the photoreceptor drum 30, the cleaning blade of the photoreceptor drum was kept in the operative position. The circumferential speed of the transfer drum 50 was the same as that of the photoreceptor drum 30 having one-half the diameter of the transfer drum. Accordingly, the image was formed while the transfer drum was rotated at a half speed of the photoreceptor drum.

The photoreceptor drum 30 was of the demand type. The drum 30 was charged again at its third or fourth revolution (in the case of the transfer drum, the second revolution). Then, the laser beam modulated by the M video signal was written on the photoreceptor drum so that the electrostatic latent image could be formed. After that, the latent image was developed by the M developing unit 37, so that the M toner image was formed. This M toner image was superimposed on the Y toner image on the transfer paper at the second revolution of the transfer drum.

In the same way, an electrostatic latent image was formed according to the C video signal and the latent image was developed by the C developing unit 38. Then, the C toner image was superimposed on the Y toner image and the M toner image on the photoreceptor drum 30 at the fifth and sixth revolutions (the third revolution of the transfer drum). An electrostatic latent image was formed according to the BK video signal and the latent image was developed by the BK developing unit 39. The BK toner image on the photoreceptor drum 30 was superimposed on the previously transferred color image on the transfer paper on the transfer drum at the seventh and eighth revolutions of the photoreceptor drum 30 (the fourth revolution of the transfer drum 50). In this way, the color toner image was formed on the transfer paper. The transfer paper on which the color image was formed, was separated from the transfer drum 50 by the separation claw 52 which was activated by the operation member 71. The transfer paper was conveyed by the suction conveyor belt 58 to the fixing unit 80 in which the color image was fixed by heat. After fixing, the transfer paper was delivered by the roller 90 facedown.

The color image forming apparatus by which the second object of the present invention can be accomplished, is provided with an upper box unit which can be opened and closed with regard to the apparatus in which a process cartridge provided with image forming units and a transfer drum, are installed and in which a writing unit is also installed. When the upper box unit is opened, a space is made between the upper box unit and the apparatus. The space is utilized in order to remove the process cartridge from the apparatus and to install it in the apparatus.

The above-described image forming units are a photoreceptor drum, a charger, a cleaning unit, a waste toner collecting unit and the like, and they are installed in the process cartridge. Furthermore, a plurality of color developing units such as the developing units of yellow (Y), magenta (M), cyan (C) and black (BK) are installed in the cartridge, wherein the developing units are arranged around the lower circumferential surface of the above-described photoreceptor drum. The above-described transfer drum is located above the photoreceptor drum. In order to arrange the image forming units stably, the transfer drum is located off to the upper left of the photoreceptor drum as follows. When the horizontal plane on which the shaft center of the photoreceptor drum lies, makes an angle of $\theta$ with the inclined plane on which both the shaft center of the photoreceptor drum and the shaft center of the transfer drum lie, it is common that the value of 0 is represented by the inequality of $10° \leqq \theta \leqq 80°$, and it is preferable that the value of $\theta$ is represented by the inequality of $20° \leqq \theta \leqq 70°$.

The above-described image forming units may be individually provided to the process cartridge, or they may be provided to the cartridge as a unit, which are a unit of the photoreceptor drum and the charger, a unit of the cleaning unit, the waste toner collecting unit and the waste toner conveyance tube, and developing units. A unit to which the photoreceptor drum, the charger, the cleaning unit and the waste toner collecting unit are integrally provided, may be also adopted. Furthermore, all the image forming units including the developing units may be integrally formed into a unit. The transfer drum and the image forming units located around it may be integrally formed into a unit. The unit including the above-described image forming units and the transfer drum unit may be replaced as a unit when the lid provided to the upper portion of the apparatus is opened and the process cartridge is removed from the apparatus. The above-described process cartridge may be used until it reaches its limit, and then it may be replaced.

Color images are formed by this color image forming apparatus in such a manner that; the laser beam of the LED or the laser unit is modulated by the color data signal sent from the outside of the apparatus or from the color scanner installed in the apparatus; and the modulated beam is written on the surface of the photoreceptor drum at each color so that an electrostatic latent image can be formed on the drum. This electrostatic latent image is developed in order to form a color toner image and the toner image is transferred onto a transfer paper wound around the transfer drum. The above-described processes are repeated at each color signal and color toner images of each color are superimposed on the transfer paper, so that a color image can be formed. After that, the transfer paper on which the color image is formed, is separated from the transfer drum and the color image is fixed.

In the color image forming method described above, a specialized color image forming method, such as the method disclosed in Japanese Patent Publication Open to Public Inspection No. 76766/1985 in which each color toner image is superimposed on the photoreceptor drum, is not used, and color image forming is conducted in the same process as the ordinary black and white image forming, which is advantageous. Furthermore, this method can adopt what is called the demand type in which a photoreceptor drum of small diameter can be used. Accordingly, the image forming units arranged around the circumferential surface to the drum can be made compact. As a result, the apparatus as a whole can be made compact.

The above-described process cartridge can be removed from the apparatus in such a manner that; at the outset, the upper box unit is opened upward with regard to the apparatus so that a space necessary for pulling out the cartridge to the operator's side can be made; and the cartridge is lifted upward along the guide provided to the apparatus. When the cartridge is lifted, the side wall of the cartridge is guided by an inclined guide which is formed by extending the above-described guide. When the process cartridge is installed, the upper box unit is opened. Installation of the cartridge is the reversal of the removal. After the cartridge is installed, the upper box unit is closed for image forming.

Simultaneously with the installation of the process cartridge, the gears, for example, provided to the extended portions of the photoreceptor drum shaft and the transfer drum shaft, engage with the driver gear provided to the apparatus. It is preferable that a plurality of above-described developing units are provided with toner supply units. For example, the toner is supplied from the toner supply unit of each color provided to the apparatus, to the toner supply unit provided to the developing unit through the toner conveyance tube.

Since the color image forming apparatus has the structure described above, the apparatus can be made compact and simplified, so that the quality of color image can be stabilized.

EXAMPLE 4

The following are the description of one of the examples of the present invention. However, it is to be understood that the invention is not intended to be limited to the specific embodiments.

Figure 7:
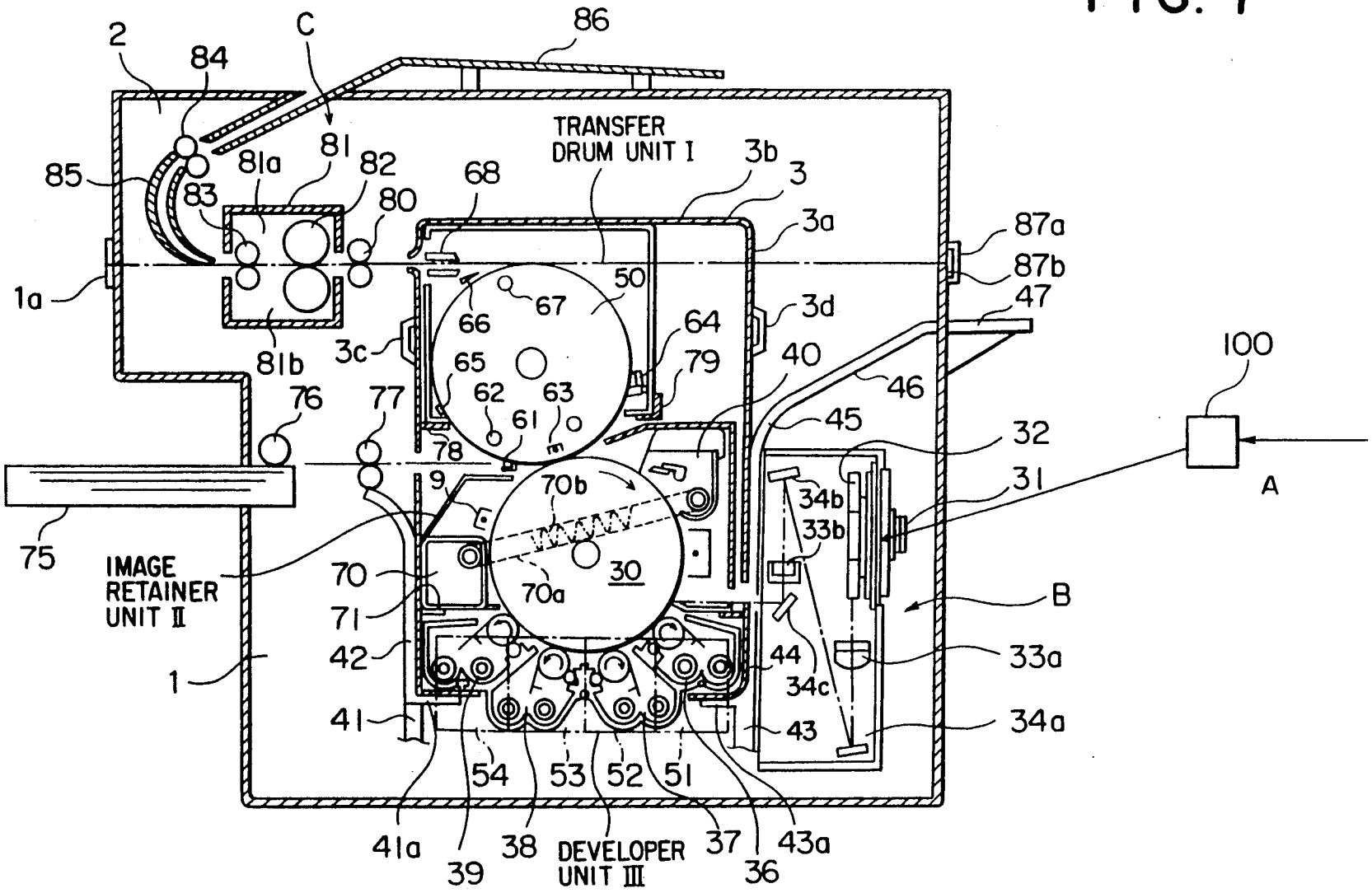
FIGS. 7 and 8 are sectional views which illustrate the structure of a color printer.
Figure 8:
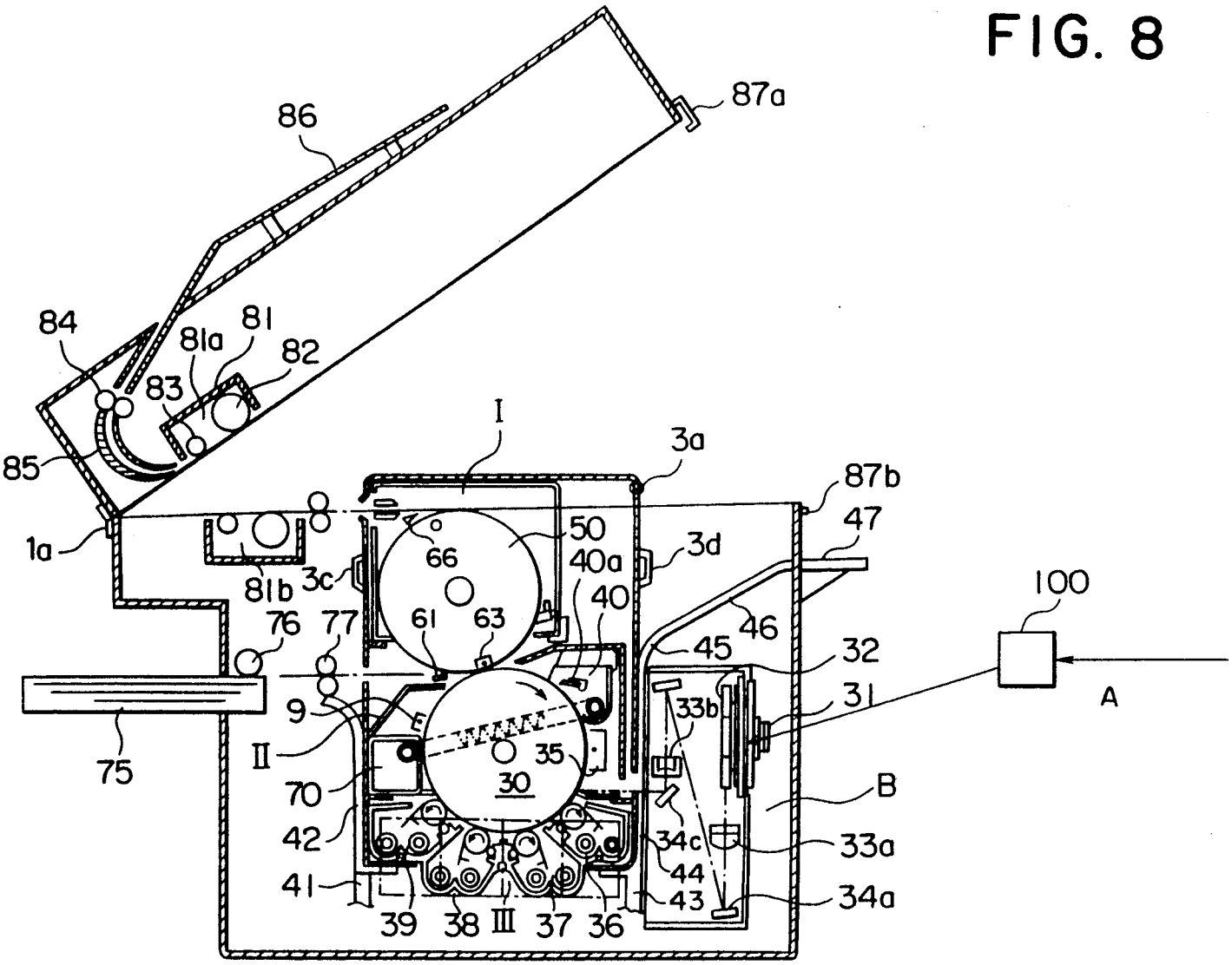
Figure 9:
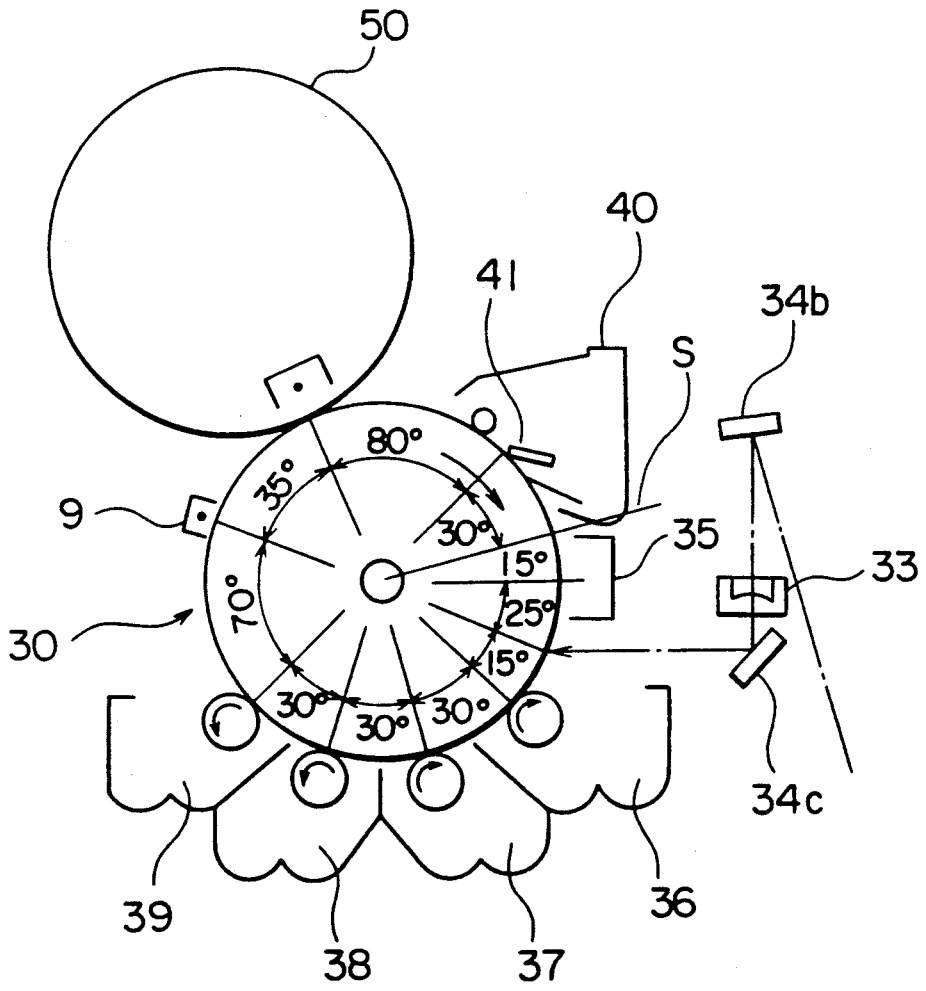
FIG. 9 is a drawing which illustrates the arrangement of each image forming unit in the process cartridge.
Figure 10:
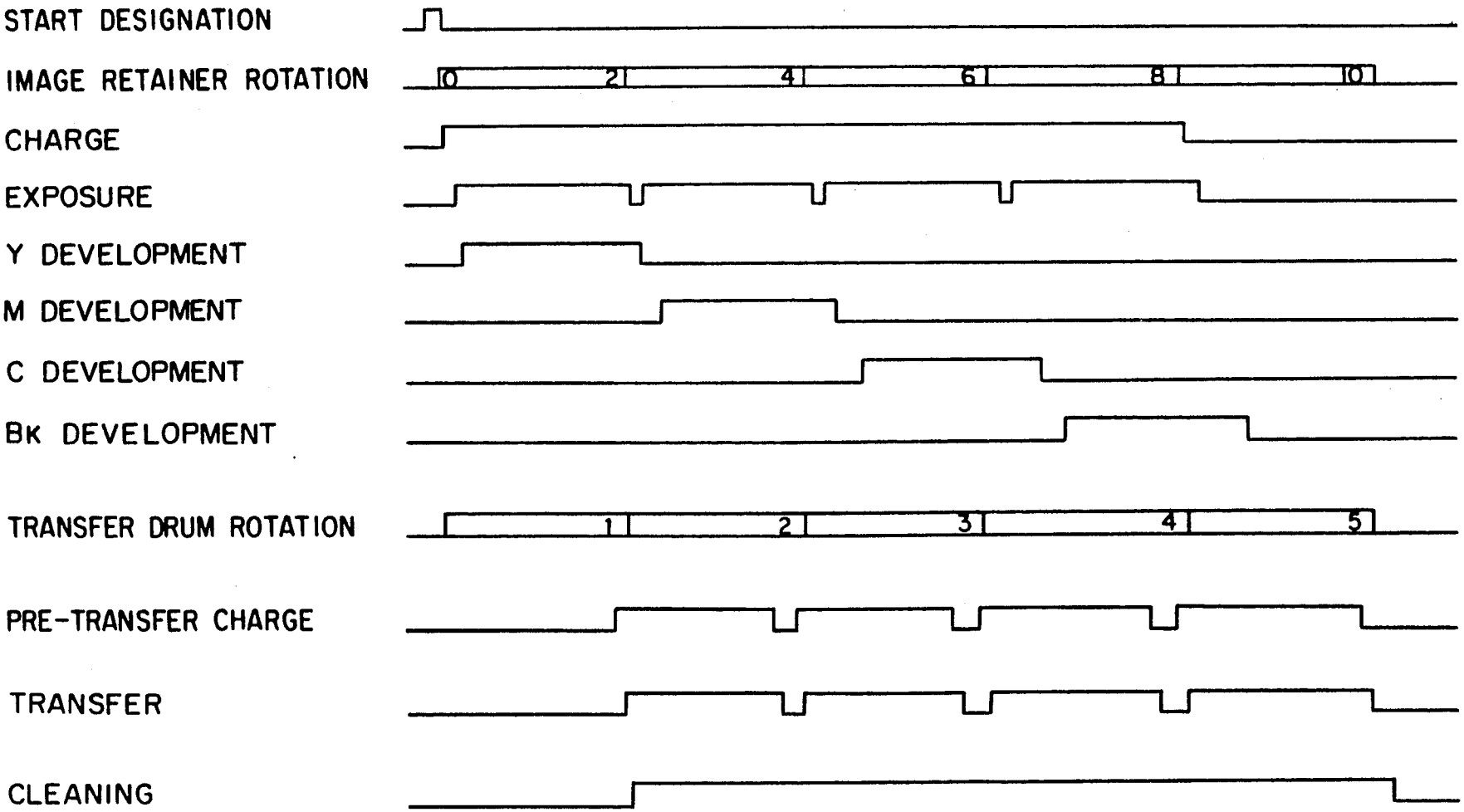
FIG. 10 is a time chart which illustrates image forming.

FIGS. 7, 8, 9, and 10 are drawings which illustrate the examples of the present invention. FIG. 7 is a sectional view of the apparatus when the lid is closed. FIG. 8 is a sectional view of the apparatus when the lid is opened. FIG. 9 is a schematic illustration which shows the arrangement of the image forming units and the transfer drum in the process cartridge. FIG. 10 is a time chart of image forming.

In the printer of this example, the upper box unit 2 including the paper delivery system C such as the upper portion 81*a* of the fixing unit 81, the paper delivery guide 85, the paper delivery roller 84 and the paper delivery tray 86, is provided to the apparatus 1 including the process cartridge 3, the writing unit B, the paper supply cassette 75 and the lower portion 81*b* of the fixing unit 81, wherein the upper box unit 2 is connected with the apparatus 1 by the hinge 1*a* so that it can be opened and closed with regard to the apparatus 1.

The transfer drum unit I, the photoreceptor unit II and the developing unit III are installed in the process cartridge 3 in this order. The above-described transfer drum unit I is provided with the transfer drum 50, the clamper 61 which is the auxiliary unit of the transfer drum 50, the clamper operation unit 62, the transfer pole 63, the presser 64, the charger 65, the separation claw 66, the separation claw operating unit 67 and the transfer paper guide 68 which is used to guide the paper after transfer. This transfer drum unit I is supported by the support members 78 and 79 which are provided to the inside wall of the process cartridge.

The above-described photoreceptor unit II is provided with the photoreceptor drum 30, the pre-transfer charger 9, the cleaning unit 40, the transfer pole 35, the waste toner collecting unit 70 and the waste toner conveyance tube 70*a* having the screw conveyor 70*b* for use in waste toner conveyance. The photoreceptor unit II is supported by the support members 71 and 72 which are provided to the inside wall of the cartridge.

The developing unit III is provided with the developing units 36, 37, 38 and 39 which share some portions of the wall so that they can be integrally installed in the process cartridge, wherein the developing units are arranged around the lower circumferential surface of the photoreceptor drum 30. The above-described developing units are supported by the bottom portion of the process cartridge 3. There is a rectangular opening at the center of the bottom portion of the process cartridge 3 and the developing units 37 and 38 are protruded downward from the opening.

As described above, the developing units 37, 38, 38 and 39 are arranged around the lower circumferential surface of the photoreceptor drum 30 and the opening portions of the developing rollers 36*a*, 37*a*, 38*a* and 39*a* are arranged upward, in other words the developing units are vertically placed.

The developing units 36, 37, 38 and 39 are located both on the right side and on the left side with regard to the center line of the photoreceptor drum. To be more concrete, The developing units 36 and 37, and the developing units 38 and 39 are symmetrically located with regard to the shaft center of the photoreceptor drum. Furthermore, the developing sleeves of the developing units 36 and 37 which are located on the right side, are rotated counterclockwise, and the developing sleeves of the developing units 38 and 39 which are located on the left side, are rotated clockwise. Development is conducted in the developing units explained above.

Since a group of developing units are located in the manner described above and two of the developing sleeves are reversely rotated, the process units in the cartridge 3 are well-balanced in terms of weight and power transmission. Accordingly, the apparatus has high maneuverability and harmful oscillation can be prevented.

It is possible that the developing units 36 and 39 which are symmetrically located, can have the same structure, and that the developing units 37 and 38 which are symmetrically located, can have the same structure. Furthermore, the waste toner can be effectively scraped off from the developing sleeves by the action of gravity after development has been conducted, and the adequate amount of fresh toner can always been supplied.

The procedure to remove the process cartridge 3 from the apparatus 1 is as follows: at the outset, as illustrated in FIG. 8 the upper box unit 2 is opened so that it makes an angle of 30° to 90° with the horizontal plane, wherein the angle is 45° in this example; the cartridge 3 is lifted upward by pulling the handles 3*c* and 3*d* provided to the side walls of the cartridge 3, along the guides 42 and 44 which are extended from the base plates 41 and 43; when the cartridge 3 passes through the inclined portions 45 where the guide 44 continues to the inclined portion 46, the cartridge 3 is inclined and lifted to upper oblique direction; and when the cartridge 3 passes through the portion where the inclined portion 46 continues to the horizontal portion 47 of the guide, the cartridge 3 is laid down and taken out from the apparatus. After the cartridge 3 is taken out, the lid 3*b* provided to the upper portion of the cartridge 3 is opened on the hinge 3*a* so that at least one of the transfer drum unit I, the photoreceptor drum unit II and the developing unit III can be replaced. The cartridge 3 itself may be replaced without opening the lid 3. When the process cartridge 3 is installed in the apparatus after the unit was replaced, installation of the cartridge is the reversal of the removal. The procedure is as follows: the side wall of the cartridge to which the handle 3*d* is provided, is moved along the horizontal portion 47 of the guide 43, the inclined portion 46 and the vertical portions 42 and 44 of the guide 43 so that the cartridge can be set on the supports 41*a* and 43*a* of the base members 41 and 44. Simultaneously with the setting of the process cartridge 3, the gear provided to the extension of the photoreceptor drum shaft, engages with the driver gear of the apparatus so that the gear can be driven. The transfer drum and the developing units becomes possible to be driven by a group of gears which engage with the gear provided to the photoreceptor drum shaft. Simultaneously with the setting of the process cartridge 3, the toner supply tube of the toner supply units 51, 52, 53 and 54 are connected with the developing units so that the toner can be supplied to the developing units.

Image forming of this example was conducted as follows with the color printer having the above-described structure. In the color image forming apparatus in which a color image is transferred onto the transfer drum 50 at each revolution, image forming can be conducted in a manner of what is called the demand type, wherein a small photoreceptor drum having one-half the diameter of the transfer drum is used, for example. Since a photoreceptor drum the diameter of which was the same as that of the transfer drum, was used in the present example, the photoreceptor drum and the transfer drum were synchronously rotated by 5 revolutions so that a color image was formed, which will be explained with a timing chart later.

This electrostatic latent image which was formed on the photoreceptor drum 30, was developed by the method of noncontact-reversal-development with the Y-developing unit 36 in which a two-component developer was contained and on which the developing bias was impressed, wherein the D.C. component of the developing bias was −500 v and the A.C. component was 3 KHz, 1 KV. In this way, the Y-toner image was formed on the photoreceptor drum 30. This Y-toner image was transferred onto a transfer paper conveyed from the transfer paper cassette 75 and wound around the transfer drum 50 which was rotated synchronously with the photoreceptor drum 30.

The transfer paper was conveyed from the transfer paper supply cassette 75 by the paper feed roller 76 to the transfer drum 50 through the timing roller 77 synchronously with image forming of the photoreceptor drum 30. The clamper 61 of the transfer drum 50 was activated by the operation member 62, and it clamped the tip of the transfer paper. At the same moment, the transfer paper was electrostatically attracted by the transfer drum which was charged by the charger 65 beforehand, so that transfer paper was wound around the transfer drum 50. The presser 64 is for winding the transfer paper around the transfer drum 50 uniformly. The above-described Y toner image was transferred onto the transfer paper on the transfer drum by the action of the transfer pole 63. The transfer paper onto which the Y toner image was transferred, was rotated so that the next color toner image could be transferred, wherein the separation claw 66, the charger 65 and the presser 64 were kept in the in operative position. While the image was formed on the photoreceptor drum 30, the cleaning blade **40*a*** of the photoreceptor drum was kept in the operative position.

After the photoreceptor drum 30 was charged by the charger 35 at the second revolution, the laser beam modulated by the M video signal was written on the photoreceptor drum 30 and the M toner image was developed by the M developing unit in the same way described before. This M toner image was superimposed on the Y toner image on the transfer paper wound around the transfer drum 50 which was rotated synchronously with the photoreceptor drum 30 while the separation claw 66 was released. After the transfer, the residual toner on the photoreceptor drum 30 was cleaned by the cleaning unit 40. Then the photoreceptor drum 30 was charged by the charger 35 again. After that, at the third revolution of the photoreceptor drum 30 and fourth revolutions of the transfer drum 50, the C toner image and the BK toner image which were formed on the photoreceptor drum 30 according to the C video signal and the BK video signal, were transferred on the Y toner image and the M toner image on the transfer paper wound around the transfer drum 50, so that the color toner image was formed. The transfer paper onto which the color toner image was transferred, was released from the clamper 61 and separated from the transfer drum 50 by the separation claw 66. Then the paper was conveyed to the fixing roller 82 of the fixing unit 81 by the conveyance roller 80, so that the color image was formed. After transfer, the transfer paper was delivered onto the delivery tray 86 through the conveyance rollers 83 and 84 and the guide 85.

FIG. 9 is a schematic illustration which shows the positional relation between the photoreceptor drum 30 and the image forming units which were illustrated in FIG. 7 and FIG. 8.

Assume that the photoreceptor drum 30 is rotated clockwise in FIG. 9 and the mark S shows the standard position. In the drawing, the phase of revolution of the photoreceptor drum at the end of cleaning and the positions of image forming units are shown by the angle in relation to the mark S.

In this case, the processes such as charging, latent image forming, toner image forming, transferring and cleaning of the residual toner were performed according to the time chart shown in FIG. 10. While the photoreceptor drum 30 was rotated by 5 revolutions, the transfer of an image of each color onto the paper on the transfer drum, the separation of transfer paper from the transfer drum, the cleaning of the photoreceptor drum and the like, were completed, which was defined as one cycle. In the above-described photoreceptor unit II, the waste toner removed from the photoreceptor drum 30 by the cleaning unit 40 was conveyed through the waste toner conveyance tube **70*a* provided to the back of the photoreceptor drum 30, and collected by the waste toner collecting unit 70** in the above-described photoreceptor unit II.

The waste toner conveyance screw conveyor **70*b* having flexible structure and driven by the drive system of the lower box unit 1, was installed in the above-described waste toner conveyance tube 70*a*, and the waste toner was conveyed to the waste toner collecting unit by the screw conveyor 70*b***.

In this example, the toner was supplied from the above-described toner supply units 51, 52, 53 and 54 to the developing units of the developing unit III, and the waste toner was conveyed from the cleaning unit 40 to the waste toner collecting unit 70. This operation was repeated 20000 times in order to form color images. At this point of image forming, consideration was given to the fatigue of the carrier in the developer, and the process cartridge 3 was removed from the apparatus 1 so that only the developing units III placed at the lower most could be replaced, wherein the lid **3*b* was opened to replace the developing unit III. After the replacement, the process cartridge was installed in the apparatus 1 again so as to continue image forming. Then, the developing unit III was replaced at each 20000 times and color images were formed 80000 times in total. At this point of image forming, consideration was given to the fatigue of the photoreceptor drum and the contamination of the transfer drum by toner, and the process unit 3** was replaced so as to prepare for the next image forming.

During the image forming, the above-described developing unit III and the process cartridge 3 could be easily replaced and the color images of high quality could be stably obtained.

In this example, the present invention was applied to a color printer. It may be applied to a color copier to which a color scanner is provided.

Figure 11A:
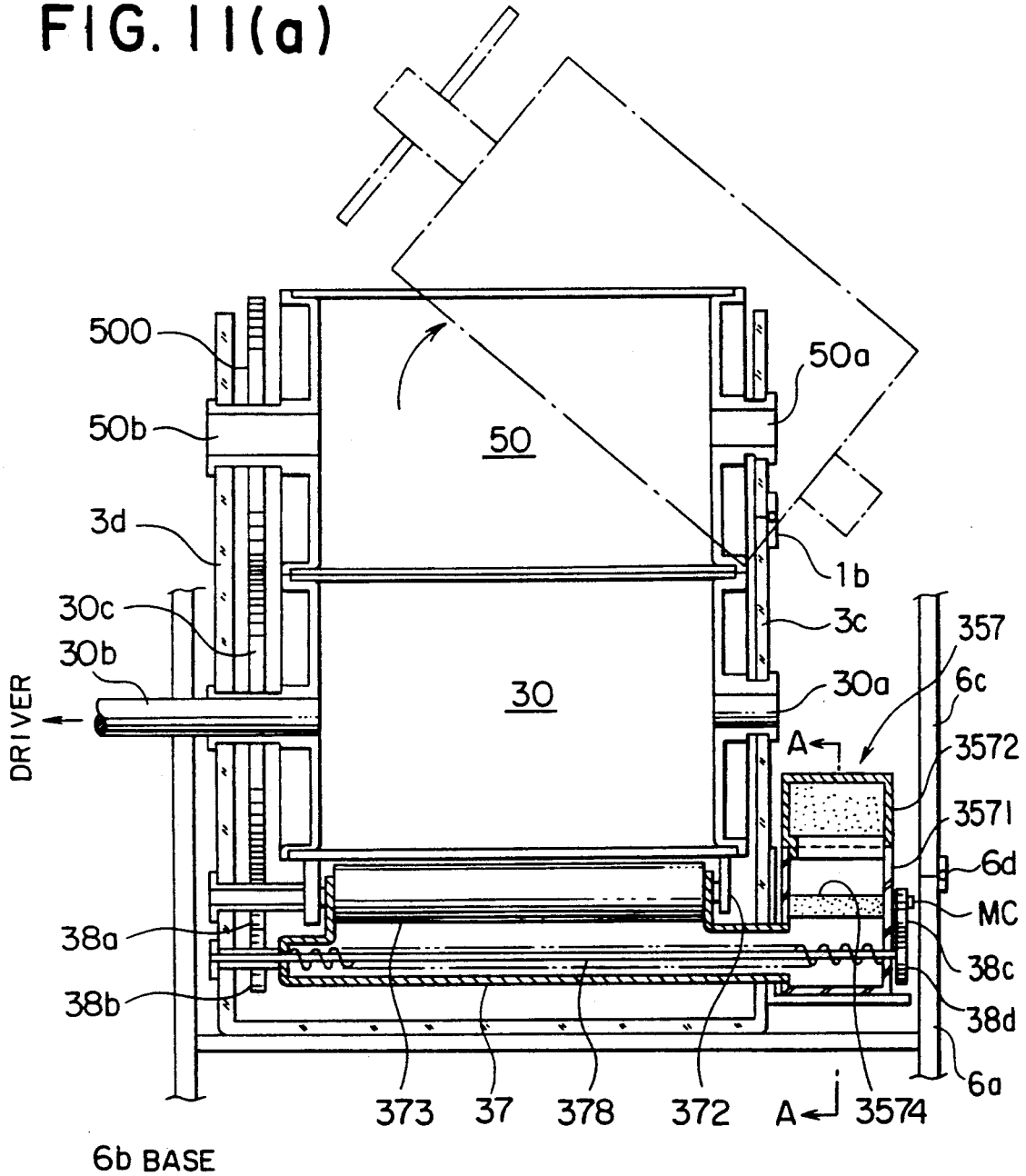
FIG. 11(*a*) is a sectional view of the process cartridge.
Figure 11B:
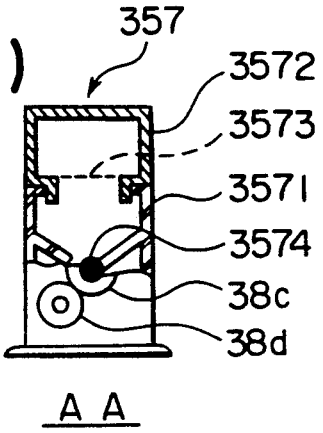

To one of the examples of a color printer in which the image forming members are assembled into units, the example structure of the developing unit 37 and the toner supply unit 357, illustrated in FIG. 11(*a*) and FIG. 11(*b*), can be applied.

In the drawings, the numeral 373 is a developing roller to which the toner is supplied from the toner supply unit 357 by the screw conveyor 378. The numeral 372 is a spacing roller by which the distance between the photoreceptor drum 30 and the developing roller 373 can be set. The developing roller 373 and the toner supply screw conveyor 378 can be rotated by the gears 38*a* and 38*b* which engage with the gear 30*c* provided to the photoreceptor drum shaft. The housing of the toner supply unit 357 is integrally provided to the extended portion of the housing of the developing unit.

In FIG. 11(*a*) and FIG. 11(*b*) which is a sectional view taken on line A—A of FIG. 11(*a*), the numeral 3571 is a toner supply portion and the numeral 3572 is a toner supply box the bottom portion of which is provided to the upper opening of the toner supply portion 3571. The toner supply box 3572 can be replaced when the toner was consumed. The numeral 3573 is a shutter which is opened and closed when the toner supply box 3572 is replaced. The numeral 3574 is a toner supply roller. The toner is supplied in such a manner that: the magnetic clutch MC is activated according to the signal sent from the toner density sensor (not illustrated in the drawings); the gear 38*c* is engaged with the gear 38*d* by the action of the magnetic clutch MC; and the toner supply roller is rotated so that the toner can be supplied.

For the toner supply box 3572 is replaced, the front door 6*c* is opened toward the operator's side on the hinge 6*d* which is provided to the front base plate 6*a* of the apparatus 1.

It is clear that according to the color image forming apparatus of the present invention, the following effects can be produced: the color image of high quality can be stably obtained; the apparatus can be made compact; the units arranged in the apparatus are well-balanced; jam-clearing can be easily conducted; and the parts can be easily replaced for maintenance. Furthermore, according to the image forming apparatus of the present invention, the following effects can be produced: the image forming units in the apparatus can be easily maintained; the quality and stability of color images can be guaranteed; and the apparatus can be made compact.

What is claimed is:

1. A clamshell type color image forming apparatus, comprising:

latent image holding means for holding a latent image on a surface thereof, said latent image holding means having an upper portion and a lower portion;

charging means for charging said surface of said latent image holding means;

forming means for forming said latent image on said charged surface of said latent image holding means;

developing means including a plurality of developing units respectively having color toners for respectively developing said latent image with said color toners;

releasable recording sheet positioning means for positioning and holding a recording sheet, onto which said developed latent image is to be transferred, adjacent to said latent image holding means;

cleaning means for cleaning residual toner from said latent image holding means after said developed latent image has been transferred;

an upper housing and a lower housing, said upper housing being movably mounted on said lower housing;

removable cartridge means mounted in said lower housing for removably holding said latent image holding means, said developing means said cleaning means and said releasable recording sheet positioning means therein;

said developing means being positioned under said lower portion of said latent image holding means;

said cartridge means being removable as a unit from said lower housing;

said releasable recording sheet positioning means being positioned adjacent said upper portion of said latent image holding means, said releasable recording sheet positioning means including means for separating from the latent image holding means responsive to movement of said upper housing away from said lower housing and for releasing said recording sheet positioning means to allow said recording sheet to be removed from said color image forming apparatus when said recording sheet is jammed.

2. A clamshell type color image forming apparatus according to claim 1, further comprising;

supporting means for pivotally supporting said releasable recording sheet positioning means; and wherein said releasable recording sheet positioning means is rotatable on said supporting means as a fulcrum, said releasable recording sheet positioning means separating from said latent image holding means upon movement of said upper housing relative to said lower housing so that said recording sheet can be removed from said color image forming apparatus when said recording sheet is jammed.

* * * * *